US006837223B2

(12) United States Patent
Tagami et al.

(10) Patent No.: US 6,837,223 B2
(45) Date of Patent: Jan. 4, 2005

(54) INTERNAL COMBUSTION ENGINE PURGE FLOW RATE CONTROLLING APPARATUS AND METHOD

(75) Inventors: Takeshi Tagami, Saitama (JP); Kota Ikeuchi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/655,001

(22) Filed: Sep. 5, 2003

(65) Prior Publication Data

US 2004/0045538 A1 Mar. 11, 2004

(30) Foreign Application Priority Data

Sep. 6, 2002 (JP) ..... P. 2002-262009

(51) Int. Cl.[7] ..... F02M 33/02

(52) U.S. Cl. ..... 123/520

(58) Field of Search ..... 123/520, 519, 123/518, 198 DB; 60/283, 285

(56) References Cited

U.S. PATENT DOCUMENTS

| | | | | |
|---|---|---|---|---|
| 4,771,749 | A | 9/1988 | Kiuchi et al. | 123/339 |
| 5,216,995 | A | 6/1993 | Hosoda et al. | 123/520 |
| 5,224,462 | A | 7/1993 | Orzel | 123/696 |
| 6,729,319 | B2 * | 5/2004 | Mitsutani | 123/687 |
| 6,732,719 | B2 * | 5/2004 | Mitsutani | 123/520 |
| 2003/0005915 | A1 * | 1/2003 | Mitsutani | 123/674 |

FOREIGN PATENT DOCUMENTS

| | | |
|---|---|---|
| EP | 0 964 148 A2 | 12/1999 |
| JP | 3-21744 | 3/1991 |

* cited by examiner

*Primary Examiner*—Mahmoud Gimie
(74) *Attorney, Agent, or Firm*—Arent Fox PLLC

(57) ABSTRACT

A purge flow rate to be added (a value to be added or subtracted) DQPGC is calculated based on a deviation between a target purge flow rate QPGCMD (the current value) and the purge flow rate QPGC(k−1) that was calculated in the previous control cycle (step S118), and a purge flow rate QPGC (the current value) is calculated by adding (adding or subtracting) the purge flow rate to be added DQPGC which is so calculated to the previous value QPGC (k−1) of the purge flow rate (steps S130 to S132).

3 Claims, 5 Drawing Sheets

INTERNAL COMBUSTION ENGINE PURGE FLOW RATE CONTROLLING APPARATUS AND METHOD

BACKGROUND OF THE INVENTION

The present invention relates to an internal combustion engine purge flow rate controlling apparatus.

Fuel is supplied to an internal combustion engine of an automotive vehicle from a fuel feed pipe and a fuel tank via injectors. In addition, evaporative fuel produced within the fuel tank is absorbed and stored in a canister, and part of the evaporative fuel so absorbed and stored in the canister is purged to an induction system of the internal combustion engine via a purge passage. A purge control valve is provided along the purge passage, and the opening of the purge control valve is regulated according to running conditions of the internal combustion engine so as to control the flow rate of evaporative fuel purged to the induction system.

When such purging is carried out, since the total volume of fuel supplied to the internal combustion engine is a sum of the volume of fuel that is supplied via the injectors (hereinafter, referred to as a "injected fuel volume") and the volume of evaporative fuel that is purged to the induction system, in order to implement an air-fuel ratio control with good accuracy, the purge flow rate needs to determined based on the running conditions of the internal combustion engine so as to optimally control the volume of evaporative fuel so purged.

To this end, in the related art, a deviation between a target duty ratio set based on the running conditions (engine rotational speed and engine load) of the internal combustion engine (namely, the target purge flow rate) and a set duty ratio (a control duty ratio fed to an electromagnetic valve. Namely, the control purge flow rate) is calculated, and when the set duty ratio is smaller, then, a positive constant is added to the set duty ratio, whereas, when the set duty ratio is larger, then, the positive constant is subtracted from the set duty ratio, whereby the fluctuation in air-fuel ratio can be suppressed by gradually increasing or decreasing the purge flow rte (refer to, for example, Patent Literature No. 1).

[Patent Literature No. 1]

JP-B-3-21744 (page 3, FIG. 2)

In the related art, however, since the value added to or subtracted from the set duty ratio is the constant that is set in advance, in the event that a drastic change in running condition of the internal combustion engine varies the target purge flow rate largely, there is caused a problem that the control purge flow rate may delay in following the target purge flow rate and the control purge flow rate may vary largely due to a slight change in running condition of the internal combustion engine, whereby the air-fuel ratio becomes unstable and a desired output cannot be obtained, this leading to a deterioration in running properties of the internal combustion engine.

SUMMARY OF THE INVENTION

Consequently, an object of the invention is to provide, by solving the problem, an internal combustion engine purge flow rate controlling apparatus which can make the control purge flow rate follow the target purge flow rate quickly in the event that a drastic change in running condition of the internal combustion engine varies the control purge flow rate largely and which can prevent the control purge flow rate from varying largely due to a slight change in running condition, thereby making it possible to make the air-fuel ratio stable and enhance the running properties of the internal combustion engine.

With a view to solving the problem, according to a first aspect of the invention, there is provided an internal combustion engine purge flow rate controlling apparatus, including a purging unit for purging evaporative fuel produced within a fuel tank to an induction system of an internal combustion engine, a target purge flow rate calculator for calculating a target purge flow rate when purging to the induction system is implemented via the purging unit, a control purge flow rate calculator for calculating a control purge flow rate based on the target purge flow rate so calculated, and a calculator for calculating a value to be added to or subtracted from the control purge flow rate based on a deviation between the calculated target purge flow rate and a value detected previous to the calculated control purge flow rate, wherein the control purge flow rate calculator calculates the control purge flow rate by adding or subtracting the value so calculated to be added or subtracted to or from the value detected previous to the control purge flow rate.

Since the value to be added to or subtracted from the control purge flow rate or a variation of the control purge flow rate is calculated based on the deviation between the target purge flow rate (the current value) and the value detected previous to the control purge flow rate and the control purge flow rate (the current value) is calculated by adding or subtracting the value calculated to be added or subtracted to or from the value detected previous to the control purge flow rate, even in the event that a drastic change in running condition of the internal combustion engine varies the target purge flow rate largely, it is possible to make the control purge flow rate follow the target purge flow rate quickly. In addition, it is possible to prevent the large fluctuation in control purge flow rate that would be generated due to a slight change in running condition, whereby the air-fuel ratio can be made stable and the running properties of the internal combustion engine can be enhanced.

Further, according to a second aspect of the invention, there is provided an internal combustion engine purge flow rate controlling method, including the steps of purging evaporative fuel produced within a fuel tank to an induction system of an internal combustion engine, calculating a target purge flow rate when purging to the induction system is implemented, calculating a control purge flow rate based on the target purge flow rate so calculated, and calculating a value to be added to or subtracted from the control purge flow rate based on a deviation between the calculated target purge flow rate and a value detected previous to the calculated control purge flow rate, wherein the control purge flow rate is calculated by adding or subtracting the value so calculated to be added or subtracted to or from the value detected previous to the control purge flow rate.

Still further, according to a third aspect of the invention, there is provided a medium including a program for executing an internal combustion engine purge flow rate controlling method, including the steps of purging evaporative fuel produced within a fuel tank to an induction system of an internal combustion engine, calculating a target purge flow rate when purging to the induction system is implemented, calculating a control purge flow rate based on the target purge flow rate so calculated, and calculating a value to be added to or subtracted from the control purge flow rate based on a deviation between the calculated target purge flow rate and a value detected previous to the calculated control purge flow rate, wherein the control purge flow rate is calculated by adding or subtracting the value so calculated to be added or subtracted to or from the value detected previous to the control purge flow rate.

DETAILED DESCRIPTION OF THE PREFERRED EMBODIMENTS

Referring to the accompanying drawings, an internal combustion engine air-fuel ratio controlling apparatus according to an embodiment of the invention will be described below.

Figure 1:
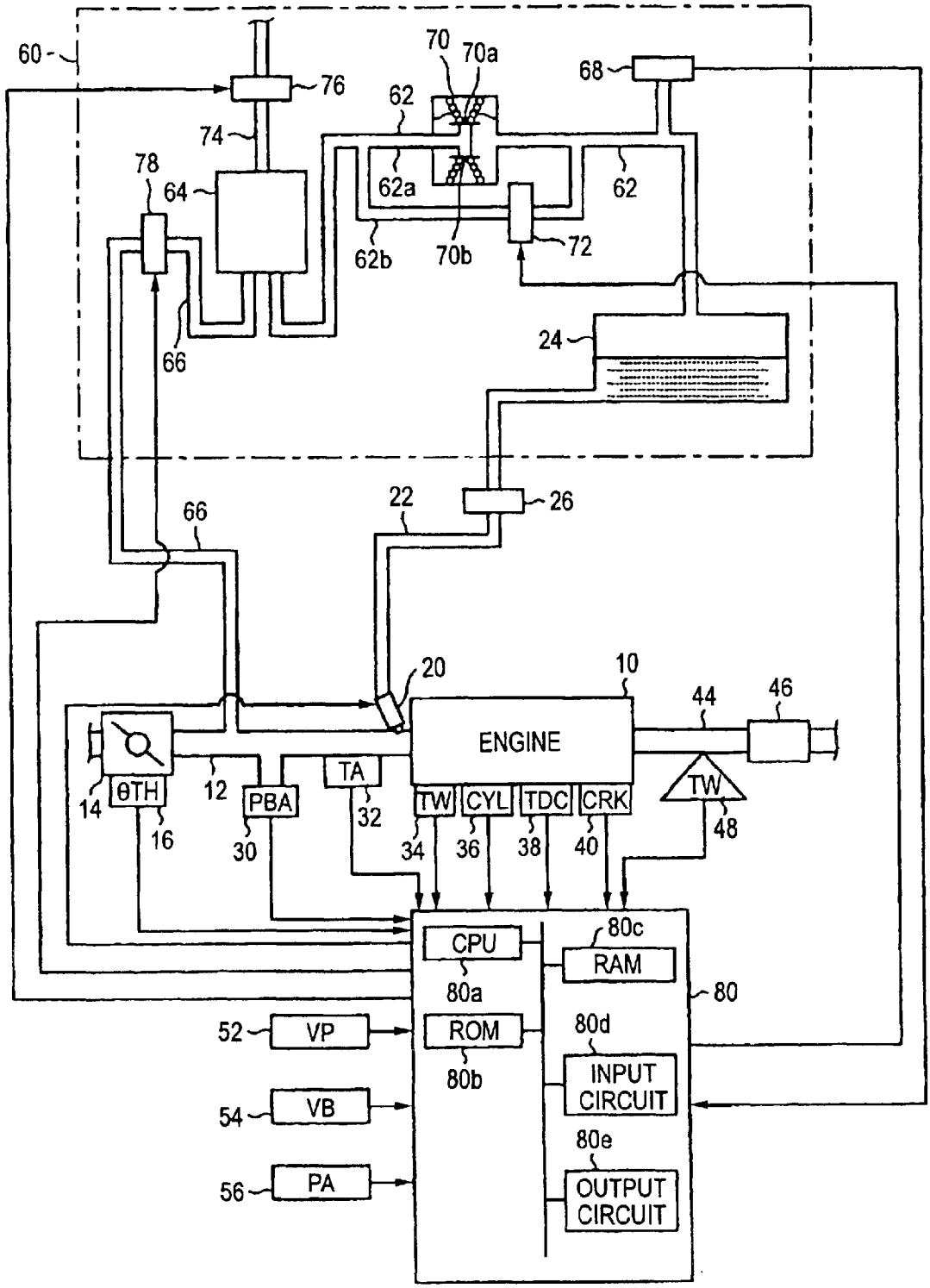
FIG. 1 is a schematic diagram showing the overall configuration of an internal combustion engine purge flow rate calculating apparatus according to an embodiment of the invention.

FIG. 1 is a schematic diagram showing the overall configuration of an internal combustion engine air-fuel ratio controlling apparatus according to an embodiment of the invention.

In the figure, reference numeral 10 denotes an internal combustion engine (hereinafter, referred to as an "engine"), and the engine 10 is, for example, in-line four-cylinder DOHC engine.

A throttle valve 14 is disposed in an air induction pipe 12 of the engine 10. A throttle position sensor 16 is provided in the vicinity of the throttle valve 14 to output a signal corresponding to the opening (throttle position) θTH of the throttle valve 14.

An injector (a fuel injection valve) 20 is provided for each cylinder (not shown) in the vicinity of an induction port immediately downstream of an induction manifold (not shown) which is situated, in turn, downstream of the throttle valve 14. The injector 20 is connected to a fuel tank 24 via a fuel supply pipe 22 and receives gasoline fuel which is sent thereto under pressure by means of a fuel pump 26 provided at an intermediate position along the length of the fuel supply pipe 22 to inject the gasoline fuel so received into the induction port.

A regulator, which is not shown, is provided between the injector 20 and the fuel pump 26 to function to make constant a differential pressure taking place between the pressure of air drawn in from the air induction pipe 12 and the pressure of fuel supplied via the fuel supply pipe 22, and when the pressure of fuel is too high, the regulator returns an excess fuel to the fuel tank 24 through a return pipe. Air drawn in via the throttle valve 14 passes through the air induction pipe 12 and gets mixed with fuel injected from the injector 20 for supply to respective cylinders of the engine 10.

An air induction pipe pressure sensor 30 and an induction air temperature sensor 32 are installed on the air induction pipe 12 at a position on a downstream side of the throttle valve 14 to output electric signals indicating an air induction pipe internal pressure (an engine load) PBA and an induction air temperature TA, respectively. In addition, a coolant temperature sensor 34 is mounted along a coolant passage (not shown) in a cylinder block of the engine 10 to output a signal corresponding to an engine coolant temperature TW.

A cylinder determination sensor 36 is mounted in the vicinity of a camshaft or crankshaft (not shown) of the engine 10 to output a cylinder determination signal CYL for a specific cylinder at a predetermined crank angle position or crankshaft position, and a TDC sensor 38 and a crank angle or crankshaft position sensor 40 are also mounted to output a TDC signal at a specific crankshaft position associated with a TDC position of each cylinder and a CRK signal at a crankshaft position (for example, 30 degrees) whose cycle is shorter than that of the TDC signal, respectively.

The engine 10 is connected to an exhaust pipe 44 via an exhaust manifold (not shown) and discharges exhaust gases produced from combustion to the atmosphere while purifying the gases with a catalytic converter (a three-way catalytic converter) provided at an intermediate position along the length of the exhaust pipe 44. A linear-air-fuel ratio (LAF) sensor 48 is provided on the exhaust pipe 44 at an upstream position of the catalytic converter 46 to generate outputs proportional to oxygen densities in a range ranging from lean to rich states.

A vehicle speed sensor 52 is disposed in the vicinity of a drive shaft (not shown) of the vehicle to output signals every time the drive shaft rotates a predetermined number of rotations. In addition, a battery voltage sensor 54 is connected to an on-board battery, not shown, to output a signal corresponding to a battery voltage VB. Furthermore, an atmospheric pressure sensor 56 is provided at an appropriate position on the vehicle to output a signal corresponding to the atmospheric pressure PA at a location where the vehicle is situated.

Next, a purge mechanism (the purging unit) 60 will be described. The purge mechanism 60 includes the fuel tank 24, a charge passage 62, a canister 64, a purge passage 66 and a plurality of control valves, which will be described later on and controls the leakage of evaporative fuel from the fuel tank 24.

The fuel tank 24 is connected to the canister 64 via the charge passage 62. The charge passage 62 has a first branch path **62*a* and a second branch path 62*b*. An internal pressure sensor 68 is mounted on the charge passage 62 on a fuel tank 24 side thereof to output a signal indicating an internal pressure of the charge passage 62**.

A two-way valve 70 is provided on the first branch path **62*a*. The two-way valve 70 has two mechanical valves 70*a* and 70*b*. The valve 70*a* is a positive pressure valve which opens when the internal pressure of the fuel tank becomes higher than the atmospheric pressure by a predetermined amount, and when the positive valve is in an open condition, evaporative fuel is allowed to flow to the canister 64 side to be absorbed and stored in the canister 64. The valve 70*b* is a negative pressure valve which opens when the internal pressure of the fuel tank becomes lower than the pressure on the canister 64 side by a predetermined amount, and when this negative pressure valve is in an open condition, the evaporative fuel absorbed and stored in the canister 64 is allowed to return to the fuel tank 24. A by-pass valve 72 which is an electromagnetic valve is provided on the second branch path 62*b*. The by-pass valve 72** is normally closed.

The canister 64 incorporates activated charcoal granules which adsorbs evaporative fuel and has an air inlet (not shown) which communicates with the atmosphere via a passage 74. A vent shut valve 76 which is an electromagnetic valve is provided at an intermediate position along the length of the passage 74. The vent shut valve 74 is normally opened.

The canister 64 is connected to the air induction pipe 12 at a position on the downstream side of the throttle valve 14 or to an induction system via the purge passage 66. A purge control valve 78 which is an electromagnetic valve is provided at an intermediate position along the length of the purge passage 66, fuel absorbed and stored in the canister 64 is purged to the induction system of the engine 10 via the purge control valve 78.

Outputs from the various types of sensors are sent to an ECU (electronic control unit) 80.

The ECU 80 is made up of a microcomputer and includes a CPU 80*a* for executing controlling operations, a ROM 80*b* which stores therein controlling operations programs and various types of data (tables and the like), a RAM 80*c* which temporarily stores the results of controlling operations executed by the CPU 80*a*, an input circuit 80*d*, an output circuit 80*e* and a counter (not shown).

Outputs from the various types of sensors described above are inputted into the input circuit 80*d* of the ECU 80. The input circuit 80*d* shapes the waveforms of input signals to modify the voltage level to a predetermined level and converts analog signal values to digital signal values. The CPU 80*a* counts CRK signals outputted by the crankshaft position sensor 40 with the counter so as to detect the engine rotational speed NE and counts signals outputted by the vehicle speed sensor 52 with the counter to detect a vehicle speed VP indicating the running speed of the vehicle.

The CPU 80*a* executes controlling operations according to programs stored in the ROM 80*b* and sends out a driving signal (an energizing command value) of the purge control valve 78 via the output circuit 80*e* (and a driving circuit, not shown) so as to continuously adjust the opening of the purge control valve 78. The CPU 80*a* also controls the purge flow rate and, similarly, adjust the openings of the by-pass valve 72 and the vent shut valve 76 to thereby control the discharge of evaporative fuel from the fuel tank 24. In addition, the CPU 80*a* similarly outputs driving signals to the injector 24 and an ignition device (not shown).

Figure 2:
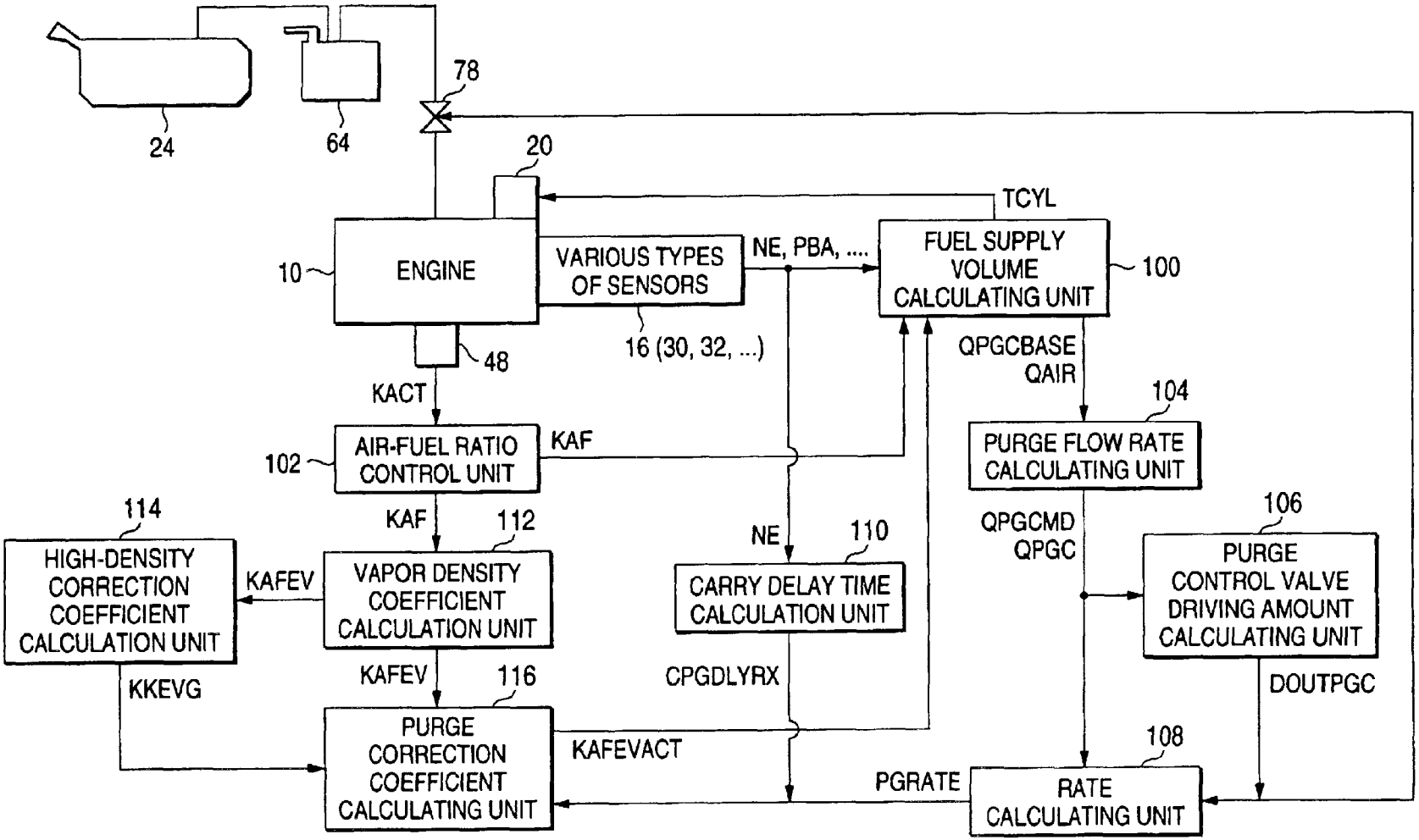
FIG. 2 is a block diagram illustrating the operation of an ECU of the apparatus shown in FIG. 1.

Next, referring to FIG. 2, the operation of the controlling apparatus according to the embodiment will be described, and more particularly, the operation of the ECU 80 will be described. FIG. 2 is a block diagram illustrating the operation of the ECU 80.

As shown in the same figure, the purge flow rate controlling apparatus according to the embodiment has a fuel supply volume calculating unit 100. The fuel supply volume calculating unit 100 receives outputs from the respective sensors and calculates a fuel injection volume TCYL that is actually injected via the injector 20 by an equation (1).

$$TCYL=TIM\times(KTOTAL\times KCMD\times KAF-KAFEVACT) \quad \text{Equation (1)}$$

In the above equation, TIM is a basic fuel injection volume, and more particularly a basic fuel injection volume (indicated by a valve opening time of the injector 20) that is determined from the engine rotational speed NE and the air induction pipe internal pressure PBA through a map retrieval. KTOTAL is a correction coefficient calculated based on detection signals from the respective sensors and is set such that the fuel consumption properties and the acceleration properties of the engine are optimized according to running conditions of the engine. In addition, KCMD is referred to as a target air-fuel coefficient and represents an air-fuel target value in terms of equivalent ratio. The target air-fuel coefficient KCMD is proportional to the reciprocal number of an air-fuel ratio A/F or a fuel-air ratio and takes a value of 0.1 with the stoichiometric air-fuel ratio.

KAF denotes an air-fuel ratio correction coefficient and is a coefficient for executing an air-fuel feedback control so that the air-fuel ratio of an air-fuel mixture supplied to the engine coincides with the target air-fuel ratio. The air-fuel ratio correction coefficient KAF is calculated based on an actual air-fuel ratio detected by the LAF sensor 48 at an air-fuel ratio control unit 102. Note that KAFEVACT is a purge correction coefficient and is a correction term for correcting the fuel injection volume TCYL in a decreasing direction. The calculation of the purge correction coefficient KAFEVACT will be described later on.

The injector 20 is opened only when the fuel injection volume TCYL calculated as has been described above is realized to inject gasoline fuel inside the fuel tank 24 into the induction port in each cylinder of the engine 10.

While calculating the fuel injection volume TCYL as has been described above, the fuel supply volume calculating unit 100 calculates (estimates) an induction air volume QAIR based on the following equation (2).

$$QAIR=TIM\times NE\times 2\times KQAIR\times KPA \quad \text{Equation (2)}$$

Where, as has been described previously, since a basic fuel injection volume TIM is determined from the air induction pipe internal pressure PBA, KQAIR is a coefficient for converting the fuel injection volume so determined to an air flow rate and is a fixed value (for example, 0.45L (liter)/mms). In addition, KPA is a coefficient for correcting a variation in flow rate corresponding to the air induction pipe internal pressure PBA.

The fuel supply volume calculating unit 100 further calculates a ratio of evaporative fuel relative to the induction air volume QAIR or a basic purge flow rate QPGCBASE based on the following equation (3).

$$QPGCBASE=QAIR\times KQPGB \quad \text{Equation (3)}$$

Where, KQPGB is a target purge rate and is set to, for example, 0.04. In this case, it follows from the rate so set that evaporative fuel is contained in 4% of the induction air volume QAIR.

Figure 3:
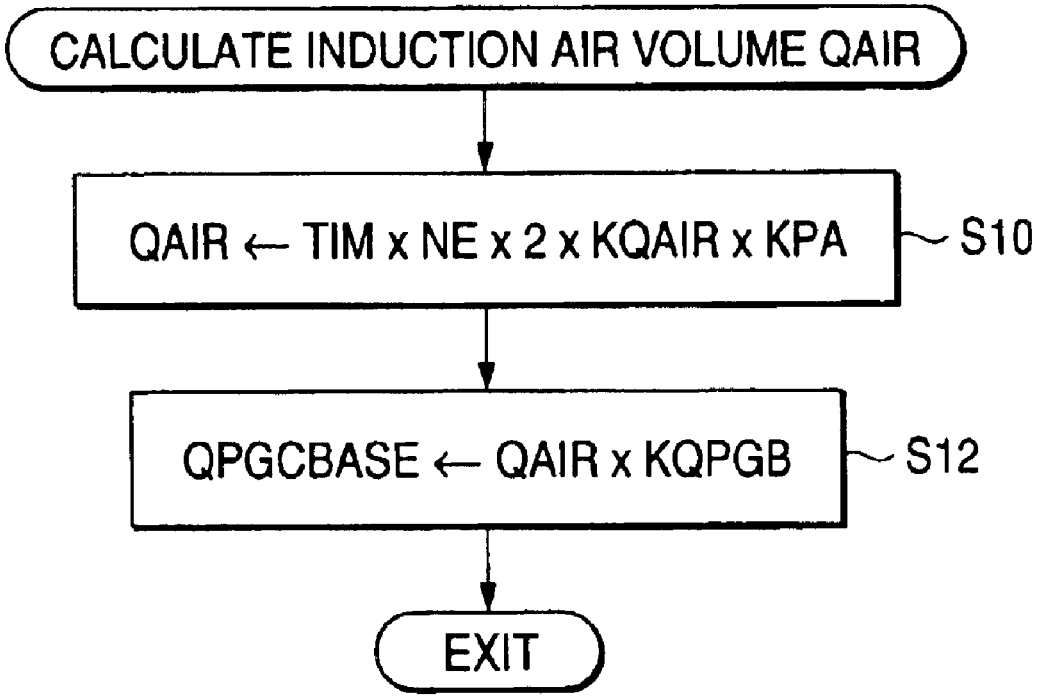
FIG. 3 is a flowchart illustrating an induction air volume calculating operation of the ECU shown in FIG. 1, among operations thereof.

FIG. 3 is a flowchart illustrating the operation of the purge flow rate controlling apparatus according to the embodiment, and more specifically, a procedure for calculating the induction air volume QAIR and the basic purge flow rate QPGCBASE by the ECU 80. A program so illustrated is executed every time a TDC signal is outputted from the TDC sensor 38, for example.

Then, the flowchart will be described as below. Firstly, in step s10, an induction air volume QAIR is obtained according to the equation (2) above. Then, advance to step S12, where a basic purge flow rate QPGCBASE is obtained according to the equation (3) above.

Returning to the description of FIG. 2, a purge flow rate calculating unit 104 calculates a target purge flow rate QPGCMAD based on the basic purge flow rate QPGCBASE calculated by the fuel supply volume calculating unit 100 by the following equation (4). The target purge flow rate QPGCMD represents a target value for the purge flow rate that is purged to the induction system of the engine in the current control cycle.

$$QPGCMD=QPGCBASE\times KPGT \quad \text{Equation (4)}$$

Where, KPGT is a purge flow rate coefficient and is set to a value which is equal to or smaller than 1. The target purge flow rate QPGCMD can be controlled by changing this coefficient KPGT. Note that the coefficient KPGT is calculated according to the running conditions of the engine.

Furthermore, the purge flow rate calculating unit 104 calculates a purge flow rate QPGC (namely, the control purge flow rate) that is to be purged in the current control cycle based on a deviation between the calculated target purge flow rate QPGCMD and the purge flow rate QPGC (k−1) that was purged in the previous control cycle (execution time in the flowchart in FIG. 3) from the following equation (5).

$$QPGC(k)=QPGC(K-1)+(QPGCMD-QPGC(K-1)\times KDQPGC \quad \text{Equation (5)}$$

Where, k denotes a control cycle (sampling time of a discrete system), (k) denotes the current control cycle (the program execution time in the current control cycle), and (k−n) denotes the control cycle n cycles back. KDPGCC is a fixed value (for example, 0.003) that is determined in advance. As is clear from the equation (5), the purge flow rate QPGC is controlled so as to reach gradually the target purge flow rate QPGCMD.

A purge control valve driving amount calculating unit 106 calculates a duty ratio PGCMD for driving the purge control valve 78 according to the following equation (6) such that the purge flow rate QPGC calculated by the purge flow rate calculating unit 104 is purged to the induction system. The duty ratio represents a ratio at which the purge control valve is opened.

$$PGCMD=PGCMD0+DPGCVBX+DPGCO$$

$$PGCMD0=QPGC\times KDUTY/KDPBG \quad \text{Equation (6)}$$

Where, KDUTY is a coefficient for converting a purge flow rate to a duty ratio and is a fixed value (for example, 3.8%·min/L) Since the purge control valve 78 changes its opening according to a differential pressure between before and after the purge control valve 78, KDPBD is a coefficient for correcting the change in opening. PGCMD0 represents a duty ratio relative to the purge flow rate QPGC and is, hereinafter, referred to as a "target duty ratio." Since a delay is caused until the purge control valve 78 starts to open, DPGCVBX and DPGC0 are both coefficients for correcting the delay (invalid time).

The purge control valve driving amount calculating unit 106 executes a limit process on the calculated duty ratio PGCMD using predetermined upper and lower limit values and outputs a final duty ratio DOUTPGC. The purge control valve 78 is controlled to be opened and/or closed according to this final duty ratio DOUTPGC.

In addition, a rate calculating unit 108 calculates a duty rate PGRATE based on the calculated final duty ratio DOUTPGC according to the following equation (7).

$$PGRATE=(DOUTPGC-DPGCVBX-DPGCO)/PGCMD0 \quad \text{Equation (7)}$$

Where, the duty rate PGRATE denotes a ratio of an actual duty ratio (a ratio from which invalid time is subtracted) relative to the target duty ratio PGCMD0 of the purge flow rate QPGC. Consequently, a value obtained by multiplying QPGC by PGRATE denotes an actual purge flow rate that is purged by the purge control valve 78 in the current control cycle.

Figure 4:
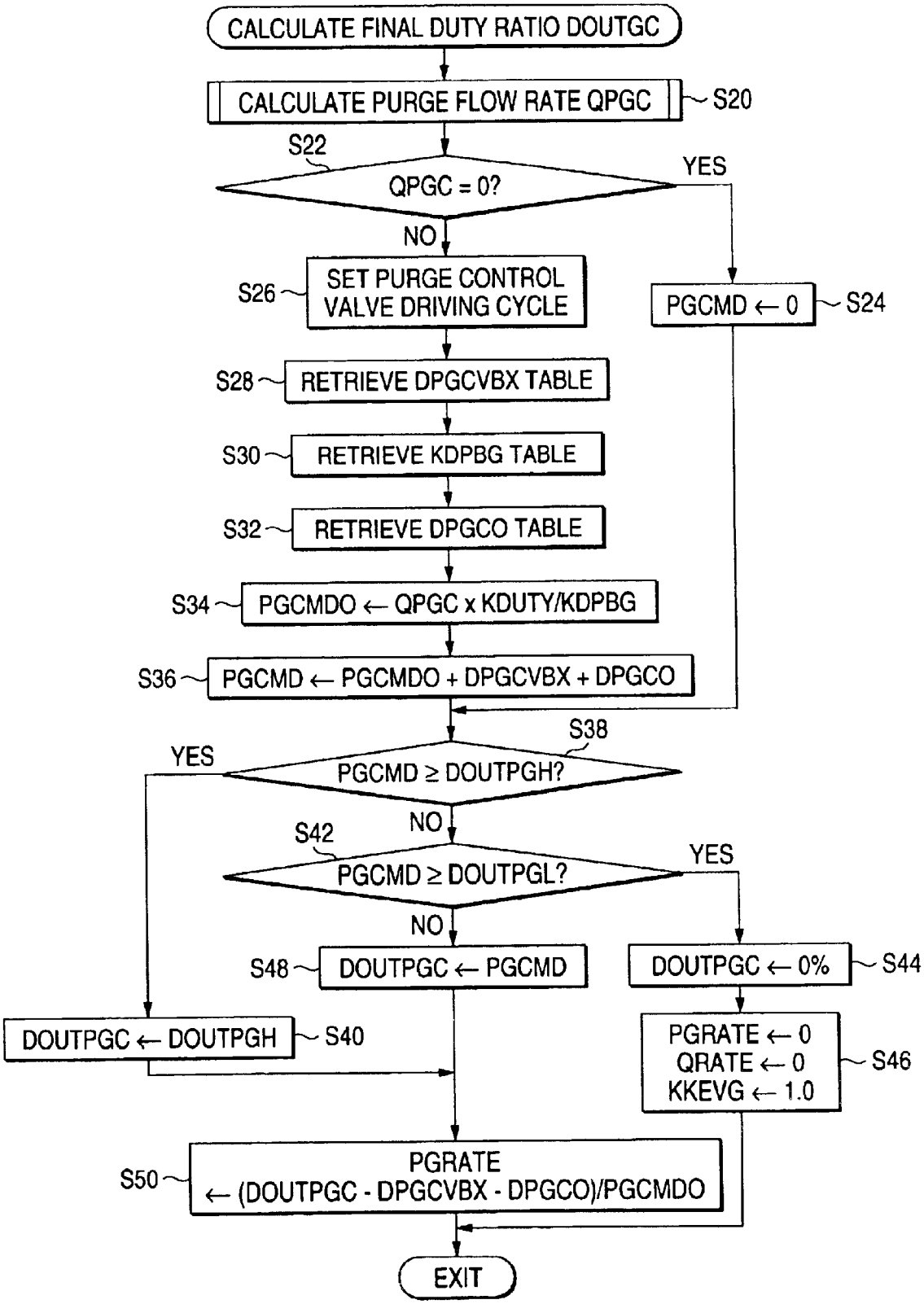
FIG. 4 is a flowchart illustrating a final duty ratio calculating operation of the ECU shown in FIG. 1, among operations thereof.

FIG. 4 is a flowchart illustrating a calculating operation of the final duty ratio DOUTPGC. A program illustrated is executed every 80 msec, for example.

Describing the flowchart, firstly, in step S20, a purge flow rate QPGC is obtained.

Figure 5:
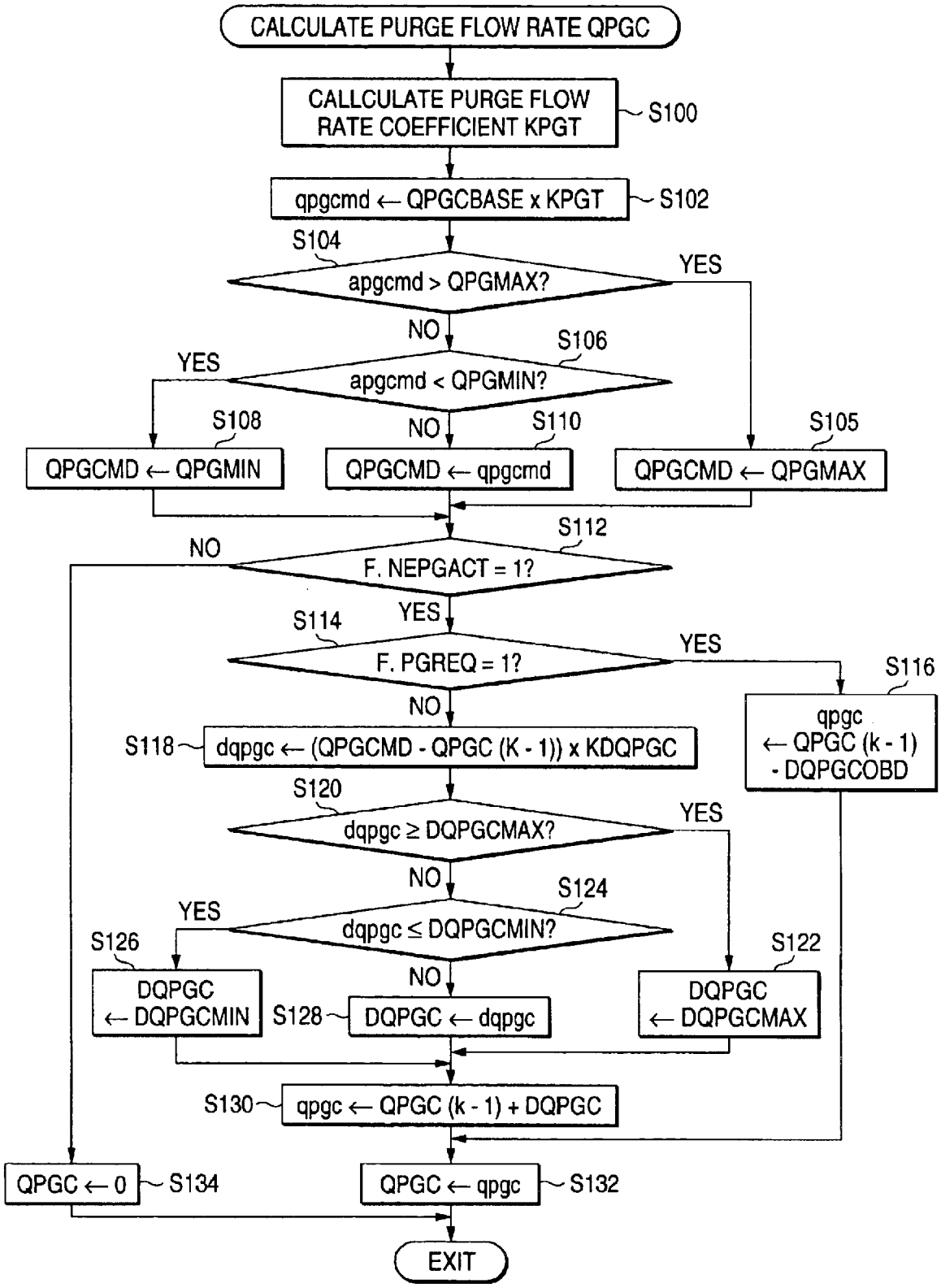
FIG. 5 is a subroutine flowchart illustrating a purge flow rate calculating operation in the flowchart shown in FIG. 4.

FIG. 5 is a subroutine flowchart illustrating a calculating operation of the purge flow rate QPGC. Describing the calculating operation of the purge flow rate QPGC by reference to the same figure, firstly, the purge flow rate coefficient KPGT is obtained in step S100. The purge flow rate coefficient KPGT is calculated according to the running conditions of the engine, as has been described before.

Next, advance to step S102, where a value obtained by multiplying the basic purge flow rate QPGCBASE by the coefficient KPGT according to the equation (4) above is made to be a transient variable qpgcmd, and then, advance to step S104, where whether or not the transient variable qpgcmd is larger than an upper limit value QPGMAX (for example, 30 L/min) that is set in advance is determined. If positive in step S104, then, advance to step S105, where the upper limit value is made to be the target purge flow rate QPGCMD, whereas if negative in step S104, then, advance to step S106, where whether the transient variable qpgcmd is smaller than a lower limit value QPGMIN (for example, 11/min) that is set in advance is determined.

If positive in step S106, then, advance to step S108, where the lower limit value QPGMIN is made to be the target purge flow rate QPGCMD, whereas if negative in step S106, or if it is determined that the transient variable qpgcmd resides between the upper limit value QPGMAX and the lower limit value QPGMIN, then, advance to step S110, where the transient variable qpgcmd is made to be the target purge flow rate QPGCMD.

Next, advance to step S112, where whether or not the bit of a purge permission flag F.NEPGACT is set to 1 is determined. When the bit thereof is set to 1, the purge permission flag F. NEPGACT (whose initial value is 0) indicates that the execution of purge is permitted. If positive in step s112, then, advance to step S114, where whether or not the bit of a purge cut demand flag F. PGREQ is set to 1 is determined. When the bit thereof is set to 1, the purge cut demand flag F. PGREQ (whose initial value is 0) indicates that a purge cut demand is being made.

If in positive in step S114, then, advance to step S116, where a value obtained by subtracting a predetermined value DQPGCOBD (for example, 2 L/min) from the purge flow rate QPGC(k−1) calculated in the previous control cycle (program execution time) is made to be a transient variable qpgc. Note that the transient variable qpgc is a value which will be made to be a purge flow rate QPGC (the current value) in a step which will be described later. Namely, when the purge cut demand is being made, the purge is attempted to be completed smoothly by decreasing the purge flow rate QPGC by a predetermined value DQPGCOBD each time.

On the other hand, if negative in step S114, then, advance to step S118, where a value obtained by multiplying a value (a deviation) obtained by subtracting the purge flow rate QPGC(k−1) calculated in the previous control cycle from the target purge flow rate QPGCMD by a purge adding coefficient KDQPGC is made to be a transient variable dqpgc, where the purge adding coefficient KDQPGC is a coefficient (for example, 0.003) which determines how much is to be added to the deviation as the purge flow rate.

Next, advance to step s120, and whether or not the value of the transient variable dqpgc is equal to or larger than an upper limit value DQPGCMAX (for example, 2 L/min) that is determined in advance is determined. If positive in step S120, then, advance to step S122, and the upper limit value DQPGCMAX is made to be a purge flow rate to be added DQPGC. On the other hand, if negative in step S120, then, advance to step S124, and whether or not the value of the transient variable dqpgc is equal to or smaller than a lower limit value DQPGCMIN (for example, 0.2 L/min) that is determined in advance is determined.

If positive in step S124, then, advance to step S126, where the lower limit value DQPGCMIN is made to be the purge flow rate to be added DQPGC. On the other hand, if negative in step S124, then, advance to step S128, where the transient variable dqpgc is made to be the purge flow rate to be added DQPGC.

Next, advance to step S130, where a value obtained by adding the purge flow rate to be added DQPGC to the purge flow rate QPGC(k−1) calculated in the previous control cycle is made to be the transient variable qpgc, and in step S132, the transient variable qpgc is made to be a purge flow rate QPGC that is to be purged in the current control cycle. Note that if it is determined in step S112 that the bit of the purge permission flag F. NEPGACT is not 1, then, advance to step S134, and the purge flow rate QPGC is made to be 0.

Thus, the purge flow rate to be added DQPGC is calculated based on the deviation between the target purge flow rate QPGCMD (the current value) and the purge flow rate QPGC(k−1) calculated in the previous control cycle, and the purge flow rate QPGC (the current value) is calculated by adding the purge flow rate to be added DQPGC so calculated to the previous value QPGC(k−1) of the purge flow rate. In other words, the purge flow rate to be added DQPGC which is the variation of the purge flow rate QPGC is set to increase as the deviation increases. Consequently, even in the event that the running condition of the engine 10 varies drastically, causing the target purge flow rate QPGCMD to vary largely, since the purge flow rate to be added DQPGC is set to the large value, it is possible to allow the purge flow rate QPGC to follow the target purge flow rate QPGCMD quickly.

In addition, in the event that the running condition of the engine 10 varies slightly, since the purge flow rate to be added DQPGC is set to the small value, the purge flow rate QPGC does not vary largely in any case, whereby the air-fuel ratio can be made stable, and the running properties of the engine 10 can be enhanced.

Note that if the deviation between the target purge flow rate QPGCMD and the previous value QPGC(k−1) of the purge flow rate is a positive value (namely, the target purge flow rate QPGCMD is larger), since the purge flow rate to be added DQPGC also becomes a positive value, the purge flow rate QPGC increases. On the other hand, if the deviation between the target purge flow rate QPGCMD and the previous value QPGC(k−1) of the purge flow rate is a negative value (namely, the target purge flow rate QPGCMD is smaller), since the purge flow rate to be added DQPGC also becomes a negative value, the purge flow rate QPGC decreases. Consequently, in use, the purge flow rate to be added DQPGC is understood to become not only the value to be added but also the value to be subtracted.

In addition, from this fact, in steps S120 and S124, upper and lower limits of the purge flow rate to be added DQPGC (more particularly, the transient variable thereof) are checked, so that the variation (increased and decreased volumes) of the purge flow rate QPGC is prevented from becoming extremely large.

Returning to the description of the flowchart in FIG. 4, next, advance to step S22, where whether or not the purge flow rate QPGC calculated in step S20 is zero. If positive in step S22, or, if evaporative fuel is not purged, then, advance to step S24, where the duty ratio PGCMD is made to be zero. On the other hand, if negative in step S22, then, advance to step S26, where the cycle in which the purge control valve 78 is driven is set to, for example, 0.80 m sec.

Next, advance to step S28, and in order to correct the invalid time of the purge control vale 78 according to the battery voltage VB, a DPGCVBX table (not shown) is retrieved based on the battery voltage VB to obtain an invalid time DPGCVBX. The DPGCVBX table is set to decrease as the battery voltage increases.

Next, advance to step S30, and in order to correct a duty ratio variation attributed a differential pressure between before and after the purge control valve 78, a KDPBG table (not shown) is retrieved based on a deviation between the air induction pipe pressure PBA and the atmospheric pressure PA to obtain a differential pressure correction value DPBG. The KDPBG table is set to increase as the deviation between the air induction pipe pressure PBA and the atmospheric pressure PA increases.

Then, move to step S32, and in order to correct the invalid time of the purge control valve 78 according to the deviation between the air induction pipe pressure PBA and the atmospheric pressure PA increases, a DGC0 table (not shown) is retrieved based on the deviation between the air induction pipe pressure PBA and the atmospheric pressure PA to obtain an invalid time DPGC0. The properties of the DPGC0 table are set such that the invalid time DPGC0 increases as the deviation increases. Next, move to steps S34 and S36, and a duty ratio PGCMD is obtained according to the equation (6) above.

Next, in step S38, whether or not the duty ratio PGCMD is equal to or larger than an upper limit value DOUTPGH (for example, 95%) that is determined in advance is determined. If positive in step S38, then, advance to step S40, where the final duty ratio DOUTPGC is made to be the upper limit value DOUTPGH. On the contrary, if negative in step S38, advance to step S42, where whether or the duty ratio PGCMD is equal to or smaller than a lower limit value DOUTPGL (for example, 35%) that is determined in advance is determined. If positive in step S40, in step S44, the final duty ratio DOUTPGC is made to be zero. Furthermore, in step S46, the values of the duty rate PGRATE and a purge flow rate QRATE (which will be described later on) are both made to be zero, and the value of a high-density correction coefficient KKEVG (which will be described later on) is made to be zero.

In contrast, if negative in step S42, or, if the final duty ratio DOUTPGC resides between the upper limit value DOUTPGH and the lower limit value DOUTPGL, in step S48, the final duty ratio DOUTPGC is made to be the duty ratio PGCMD, and in step S50, a duty rate PGRATE is obtained according to the equation (7) above. Note that even if positive in step S38 and skip step S40, thereafter, also advance to step S50 to obtain a duty rate PGRATE.

Returning to the description of FIG. 2, a carry delay time calculating unit 110 calculates a carry delay time CPGDLYRX based on the engine rotational speed NE. The carry delay time CPGDLYRX denotes a time delay from the time evaporative fuel is purged to the purge passage to the time the evaporative fuel so purged is carried to the induction system of the engine 10. The carry delay time CPGDLYRX is represented by an integral number n, and it is understood that as n increases, the carry delay increases. Note, alternatively, the carry delay time maybe calculated based on the induction air volume QAIR instead of the engine rotational speed NE.

A vapor density calculating unit 112 calculates a vapor density coefficient KAFEV based on the air-fuel ratio coefficient KAF calculated at the air-fuel ratio control unit 102, the target air-fuel ratio KCMD and an actual air-fuel ratio detected.

In addition, a high-density correction coefficient calculating unit 114 calculates a high-density correction coefficient KKEVG based on the vapor density coefficient KAFEV calculated at the purge coefficient calculating unit 112, since the higher the density of evaporative fuel becomes, the more the air-fuel ratio is affected, the high-density correction coefficient KKEVG is a coefficient for correcting the degree of influence imposed on the air-fuel ratio.

A purge correction coefficient calculating unit 116 calculates a target purge correction coefficient KAFEVACZ based on various values calculated as have been described above according to the following equation (8).

$$KAFEVACZ=KAFEV\times PGRATE\times QRATE \quad \text{Equation (8)}$$

Where, QRATE denotes the rate of a purge flow rate, which is calculated according to the following equation (9).

$$QRATE=QPGC/QPGCBASE \quad \text{Equation (9)}$$

As is clear from the equations (7) and (9), a value (PGRATE×QRATE) obtained by multiplying the duty rate PGRATE by the rate of the purge flow rate QRATE represents the rate of a purge flow rate that is purged to the induction system in the current control cycle. In addition, since the degree of influence of evaporative fuel relative to the air-fuel ratio is represented as depending on the vapor density coefficient KAFEV, by multiplying "PGRATE× QRATE" by the vapor density coefficient KAFEV, a target purge correction coefficient can be obtained accurately.

The purge correction coefficient calculating unit 116 calculates a purge correction coefficient KAFEVACT based on the target purge correction coefficient KAFEVACZ according to the following equation (10).

$$KAFEVACT=KAFEVACZ\times KKEVG \quad \text{Equation (10)}$$

Where, the purge correction coefficient KAFEVACT denotes the rate of a fuel volume to which the purge flow rate QPGC contributes relative to a demanded fuel. The rate of the fuel volume to which the purge flow rate contributes is first calculated as the target purge correction coefficient as has been described above, and a value corrected by multiplying the calculated value by the high-density correction coefficient KKEVG is set as a final purge correction coefficient KAFEVACT.

The fuel supply volume calculating unit 100 corrects the fuel injection volume TCYL (the fuel volume that is to be supplied via the injector 20) according to the equation (1) above based on the purge correction coefficient KAFEVACT so calculated, whereby the total fuel volume that is supplied to the engine 10 becomes appropriate, so that the actual air-fuel ratio KACT is allowed to follow the target air-fuel ratio accurately.

Thus, as has been described heretofore, according to the embodiment, there is provided the internal combustion engine purge flow rate controlling apparatus, including the purging unit (the purge mechanism 60) for purging evaporative fuel produced within the fuel tank 24 to the induction system (the air induction pipe 12) of the internal combustion engine 10, the target purge flow rate calculating unit (the ECU 80, the purge flow rate calculating unit 104, steps S100 to S110) for calculating the target purge flow rate QPGCMD when purging to the induction system is implemented via the purging unit, and the control purge flow rate calculating unit (the ECU 80, the purge flow rate calculating unit 104, step S20, steps S112 to S134) for calculating the control purge flow rate (the purge flow rate) based on the target purge flow rate QPGCMD so calculated, the internal combustion engine purge flow rate controlling apparatus further including the unit (the ECU 80, the purge flow rate calculating unit 104, step S20, steps S118 to S128) for calculating the value DQPGC to be added to or subtracted (the purge flow rate to be added) from the control purge flow rate QPGC based on the deviation between the calculated target purge flow rate QPGCMD and the value QPGC (k−1) detected previous to the calculated control purge flow rate, wherein the control purge flow rate unit calculates (steps S130, S132) the control purge flow rate by adding or subtracting the value DQPGC so calculated to be added or subtracted to or from the value QPGC(k−1) detected previous to the control purge flow rate.

Note that while, in the embodiment above, the linear-air-fuel ratio sensor is used as the air-fuel sensor, other types of sensors such as an $O_2$ sensor may be used.

In addition, while, in this invention, the output shaft of the engine is vertical, the invention is not limited thereto but may be applied to an air-fuel ratio controlling apparatus for a marine engine for propelling a boat such as an outboard engine.

According to the aspect of the invention, Since the value to be added to or subtracted from the control purge flow rate or the variation of the control purge flow rate is calculated based on the deviation between the target purge flow rate (the current value) and the value detected previous to the control purge flow rate and the control purge flow rate (the current value) is calculated by adding or subtracting the value calculated to be added or subtracted to or from the value detected previous to the control purge flow rate, even in the event that a drastic change in running condition of the internal combustion engine varies the target purge flow rate largely, it is possible to make the control purge flow rate follow the target purge flow rate quickly. In addition, it is possible to prevent the large fluctuation in control purge flow rate that would be generated due to a slight change in running condition, whereby the air-fuel ratio can be made stable and the running properties of the internal combustion engine can be enhanced.

What is claimed is:

1. An internal combustion engine purge flow rate controlling apparatus, comprising:

a. purging unit for purging evaporative fuel produced within a fuel tank to an induction system of an internal combustion engine;

b. target purge flow rate calculator for calculating a target purge flow rate when purging to the induction system is implemented via the purging unit;

c. control purge flow rate calculator for calculating a control purge flow rate based on the target purge flow rate so calculated; and d. calculator for calculating a value to be added to or subtracted from the control purge flow rate based on a deviation between the calculated target purge flow rate and a value detected previous to the calculated control purge flow rate, wherein the control purge flow rate calculator calculates the control purge flow rate by adding or subtracting the value so calculated to be added or subtracted to or from the value detected previous to the control purge flow rate.

2. An internal combustion engine purge flow rate controlling method, comprising the steps of:

a. purging evaporative fuel produced within a fuel tank to an induction system of an internal combustion engine;

b. calculating a target purge flow rate when purging to the induction system is implemented;

c. calculating a control purge flow rate based on the target purge flow rate so calculated; and d. calculating a value to be added to or subtracted from the control purge flow rate based on a deviation between the calculated target purge flow rate and a value detected previous to the calculated control purge flow rate, wherein the control purge flow rate is calculated by adding or subtracting the value so calculated to be added or subtracted to or from the value detected previous to the control purge flow rate.

3. A medium including a program for executing an internal combustion engine purge flow rate controlling method, comprising the steps of:

a. purging evaporative fuel produced within a fuel tank to an induction system of an internal combustion engine;

b. calculating a target purge flow rate when purging to the induction system is implemented;

c. calculating a control purge flow rate based on the target purge flow rate so calculated; and d. calculating a value to be added to or subtracted from the control purge flow rate based on a deviation between the calculated target purge flow rate and a value detected previous to the calculated control purge flow rate, wherein the control purge flow rate is calculated by adding or subtracting the value so calculated to be added or subtracted to or from the value detected previous to the control purge flow rate.

* * * * *